US012070089B2

(12) United States Patent
Howell et al.

(10) Patent No.: US 12,070,089 B2
(45) Date of Patent: Aug. 27, 2024

(54) GOWN-GLOVE INTERFACE REINFORCEMENT ACCESSORY

(71) Applicant: O&M Halyard, Inc., Mechanicsville, VA (US)

(72) Inventors: Margaret A. Howell, Atlanta, GA (US); Marshall R. Dean, Cumming, GA (US); Namita A. Mithani, Alpharetta, GA (US)

(73) Assignee: O&M Halyard, Inc., Mechanicsville, VA (US)

( * ) Notice: Subject to any disclaimer, the term of this patent is extended or adjusted under 35 U.S.C. 154(b) by 0 days.

(21) Appl. No.: 16/851,370

(22) Filed: Apr. 17, 2020

(65) Prior Publication Data

US 2020/0329793 A1 Oct. 22, 2020

Related U.S. Application Data

(60) Provisional application No. 62/835,619, filed on Apr. 18, 2019.

(51) Int. Cl.
*A41D 19/00* (2006.01)
*A41D 13/12* (2006.01)

(52) U.S. Cl.
CPC ..... *A41D 19/0089* (2013.01); *A41D 13/1227* (2013.01); *A41D 19/0041* (2013.01)

(58) Field of Classification Search
CPC ..... A41D 19/0089; A41D 19/0041; A41D 19/0048; A41D 13/1227; A41D 13/1209; A41F 1/06
See application file for complete search history.

(56) References Cited

U.S. PATENT DOCUMENTS

| | | | | |
|---|---|---|---|---|
| 3,747,126 | A | 7/1973 | Hoagland | |
| 4,114,200 | A * | 9/1978 | Smith | A41D 13/1227 2/51 |
| 4,856,112 | A | 8/1989 | Effle | |
| 5,555,561 | A | 9/1996 | Plachta et al. | |
| 5,628,067 | A | 5/1997 | Meyer et al. | |
| 5,734,992 | A | 4/1998 | Ross | |
| 6,092,237 | A | 7/2000 | Baldwin | |
| 6,122,772 | A | 9/2000 | De Guzman | |
| 6,941,579 | B2 | 9/2005 | Tanenbaum | |

(Continued)

FOREIGN PATENT DOCUMENTS

| | | | |
|---|---|---|---|
| DE | 9214949 | U1 | 3/1994 |
| WO | WO 2003/0046748 | A1 | 3/2017 |

OTHER PUBLICATIONS

International Search Report and Written Opinion for PCT/US2020/028628, dated Jul. 7, 2020, 13 pages.

*Primary Examiner* — F Griffin Hall
(74) *Attorney, Agent, or Firm* — Dority & Manning, P.A.

(57) ABSTRACT

An accessory cuff is configured to reinforce a gown-glove interface to protect a wearer from exposure to potential pathogens or contaminants through vulnerabilities in the gown-glove interface. The accessory cuff includes a body extending from a proximal end to a distal end along a longitudinal axis. The body has a lumen extending therethrough from the proximal end to the distal end, and a wall surrounding the lumen. The accessory cuff is configured to create a fluid impervious barrier to prevent fluid from entering the lumen when the accessory cuff is sealed at the proximal end and the distal end.

20 Claims, 5 Drawing Sheets

(56) References Cited

U.S. PATENT DOCUMENTS

| | | | | |
|---|---|---|---|---|
| 7,269,859 | B2 | 9/2007 | Wells | |
| 7,302,711 | B1 * | 12/2007 | Tanenbaum | A41D 19/0089 2/161.7 |
| 7,451,497 | B2 | 11/2008 | Von Blücher | |
| 8,220,675 | B2 * | 7/2012 | Rohard | B25J 21/02 223/111 |
| 8,225,427 | B2 * | 7/2012 | Bevier | A63B 71/148 2/161.6 |
| 8,726,417 | B2 * | 5/2014 | McLachlan | A41D 19/0089 2/160 |
| 2003/0046748 | A1 | 3/2003 | Tanenbaum | |
| 2003/0233695 | A1 | 12/2003 | Golde | |
| 2006/0085887 | A1 * | 4/2006 | Palomo | A41D 19/0089 2/59 |
| 2008/0256677 | A1 * | 10/2008 | Loos | A41D 13/0005 2/200.2 |
| 2010/0017939 | A1 | 1/2010 | Carpenter, Jr. | |
| 2011/0239349 | A1 * | 10/2011 | Thompson | A41D 13/1209 2/48 |
| 2014/0157475 | A1 * | 6/2014 | Smith | A41D 19/0044 2/16 |

* cited by examiner

GOWN-GLOVE INTERFACE REINFORCEMENT ACCESSORY

RELATED APPLICATIONS

The present application claims priority to U.S. Provisional Application Ser. No. 62/835,619, filed on Apr. 18, 2019, which is incorporated herein in its entirety by reference thereto.

FIELD OF THE INVENTION

The subject matter of the present invention relates generally to an accessory for reinforcing a gown-glove interface.

BACKGROUND

Surgeons and other healthcare providers often wear a long-sleeved surgical suit or gown together with surgical gloves when providing care to a patient, particularly during surgical procedures, in order to ensure sterile conditions and to protect the wearer from contamination by blood and bodily fluids. In use, cuffs of surgical gloves overlap a portion of the gown sleeve on the wearer's wrist or forearm to maintain a sterile interface between the glove and the arm. However, one of the problems encountered by healthcare providers in a surgical setting is that this protective barrier may become breached during interaction of the healthcare provider with the patient. Although many improvements have been made to the materials and designs of both the surgical gowns and surgical gloves, little attention has been paid to the junction or interface between the sleeve of the gown and the glove, known as the gown-glove interface. It is at the gown-glove interface that body fluids or bloodborne pathogens, which may contain harmful or infectious diseases, can breach the protective barrier worn by the healthcare provider.

Specifically, to prepare for a surgical procedure or other situation in which a healthcare provider must wear a protective barrier such as a surgical gown and surgical gloves, a surgical gown is typically donned first, followed by the glove. The cuff of the glove extends over the distal end of the sleeve. Several vulnerabilities exist at this interface between the gown and the glove, especially for deep cavity surgeries, in which a healthcare provider's risk for exposure to bloodborne pathogens is increased. Because surgical gloves (e.g., nitrile or latex elastomeric gloves) are tighter around the hand and wrist than the sleeve, and the gown sleeve is made with excess fabric around the forearm, the material of the gown sleeve bunches where the glove overlaps with the gown sleeve. This bunching of gown material in the sleeve 10 of the gown creates channels of fabric 15, as shown in FIG. 1, that can act as runways by which blood and bodily fluids can travel down and potentially expose the wrist and hand of the surgeon to contamination if the fluids travel inside the glove. In addition, the cuff end 22 of the glove 20 can roll back towards the wearer's hand due to the tightness around the wearer's wrist or forearm. The bunching of gown material at the gown-glove interface can further encourage or cause the cuff end of the glove to roll down towards the wearer's hand. Such rolling of the glove is undesirable because it moves the protective barrier up closer to the wearer's hand, making any movement of the glove increase the chance of blood or bodily fluid exposure. Moreover, when the cuff rolls towards the wearer's hand, the non-sterile inner surface of the surgical glove can be exposed.

Although a healthcare provider washes their hands prior to surgery, their hands are not sterile, so the provider's non-sterile hands contaminate the inner surface of the glove when the glove is put on. The unsterile glove inner surface can therefore contaminate the sterile outer surface of the glove when the glove cuff rolls down.

Attempts to remedy glove roll-down have been made in various ways, including modifications of the gown sleeve, or use of adhesive or other attachment mechanisms between the gown sleeve and the cuff of the surgical glove, but the problem remains substantially unresolved.

As such, a need exists for a liquid-impervious barrier at the gown-glove interface. In particular, a liquid-impervious barrier accessory that can be used interchangeably with various models of surgical gowns, gloves or full surgical personal protective equipment bundles would also be useful.

SUMMARY

In one particular embodiment, the present invention is directed to an accessory cuff for reinforcement of a gown-glove interface. The accessory cuff includes a body extending from a proximal end to a distal end along a longitudinal axis, the body having a lumen extending therethrough from the proximal end to the distal end, and a wall defining the lumen. The accessory cuff is configured to create a fluid impervious barrier to prevent fluid from entering the lumen when the accessory cuff is sealed at the proximal end and the distal end.

In one embodiment, at least one of the proximal end and the distal end can include a seal. Further, the seal can be formed by a friction fit. Moreover, the seal can be formed by adhesive. Additionally, the seal can be formed by an elastomeric material. Further, the seal can be formed by an absorptive polymer.

In another embodiment, an inner surface of the wall can include a textured portion.

In yet another embodiment, the body can further include at least one elastomeric ring surrounding the lumen.

In still another embodiment, the body can include a proximal section including the proximal end, and a distal section including the distal end. Further, the proximal section can include a first material and the distal section can include a second material, wherein the first material can be elastomeric. Moreover, the proximal section and the distal section can include the same material.

In an additional embodiment, the body can further include an inverse cuff, wherein the inverse cuff is configured to be disposed within the lumen.

In one more embodiment, the body can further include an outer wall having a lip disposed between the proximal end and the distal end.

In yet another embodiment, the body can have an adjustable fit.

In still another embodiment, the body can further include an elastic scaffold, the elastic scaffold including at least one piece of elastic material surrounding an inner layer of the wall and an adjustable fastener in operative communication with the at least one piece of elastic material. Further, the adjustable fastener can be configured to be disposed in the lumen of the body. Moreover, the elastic scaffold can be disposed between the inner layer and an outer layer of the wall.

In an additional embodiment, the body can include a nonwoven barrier sheet material.

In one more embodiment, the body can further include a waterproof zipper. In yet another embodiment, the lumen can have a first diameter at the proximal end and a second diameter at the distal end. Further, the first diameter and the second diameter may not be equal.

In yet another embodiment, the accessory cuff can be formed in one piece.

In still another embodiment, the accessory cuff can be integrally formed from one material.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
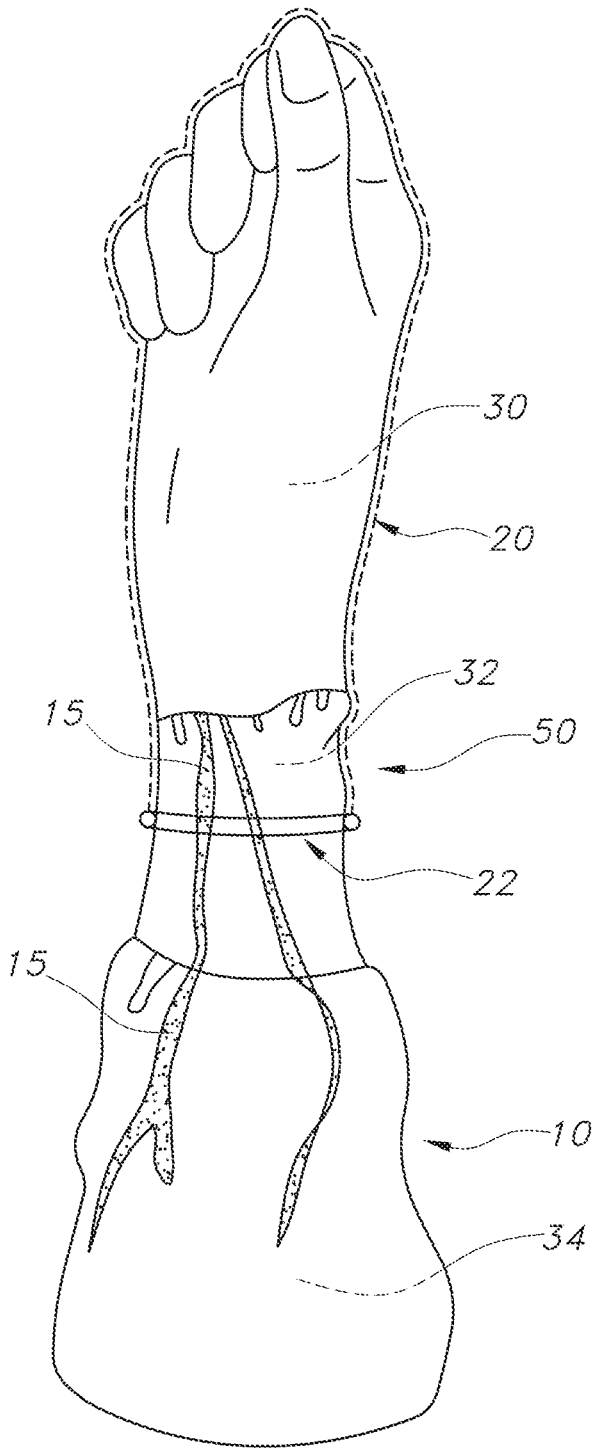
FIG. 1 (PRIOR ART)
FIG. 1 illustrates a perspective view of a gown-glove interface of the prior art.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "about," "approximately," or "generally," when used to modify a value, indicates that the value can be raised or lowered by 5% and remain within the disclosed embodiment. Furthermore, for the purposes of this description, proximal generally indicates that portion of a cuff next to or nearer to a hand of a wearer (when the cuff is in use), while the term distal generally indicates a portion further away from the hand of a wearer and nearer to the body of the wearer (when the cuff is in use).

Generally speaking, the present invention is directed to an accessory cuff for reinforcement of a gown-glove interface. The accessory cuff includes a body extending from a proximal end of the accessory to a distal end of the accessory along a longitudinal axis. The body has a lumen extending therethrough from the proximal end to the distal end, and a wall defining the lumen. The accessory cuff is configured to create a fluid impervious barrier to prevent fluid from entering the lumen when the accessory cuff is sealed at the proximal end and the distal end. The present inventors have found that the specific components of the accessory cuff, when covering and sealed over a gown-glove interface, can prevent bodily fluids and other contaminants from breaching the gown-glove barrier through channels of bunched gown sleeve fabric that are formed when a glove is secured over a gown sleeve. Moreover, the present inventors have found that donning the accessory cuff of the present invention over the gown-glove interface reduces the risk of contamination that can occur due to rolling of the cuff of the glove away from the gown sleeve. The specific features of the accessory cuff of the present invention may be better understood with reference to FIGS. 1-4B.

FIG. 1 illustrates a conventional gown-glove interface 50. The sleeve 10 of a garment, such as a surgical gown, extends over the forearm 34 and wrist 32 of a wearer. A glove 20, such as an elastomeric glove, is donned over the wearer's hand 30 and wrist 32, extending over the sleeve 10 to form the gown-glove interface 50. Bunching of the fabric of the sleeve 10 where the glove 20 extends over the sleeve 10 at the gown-glove interface 50 can create channels of fabric 15 that blood, bodily fluids, or other contaminants can travel down and potentially expose the wrist 32 and hand 30 of the wearer to contamination. Additionally, the end 22 of the glove 20 can roll towards the wearer's hand 30, decreasing the size of the gown-glove interface 50 and thereby increasing the wearer's risk of exposure to blood, bodily fluids, or other contaminants.

Figure 2A:
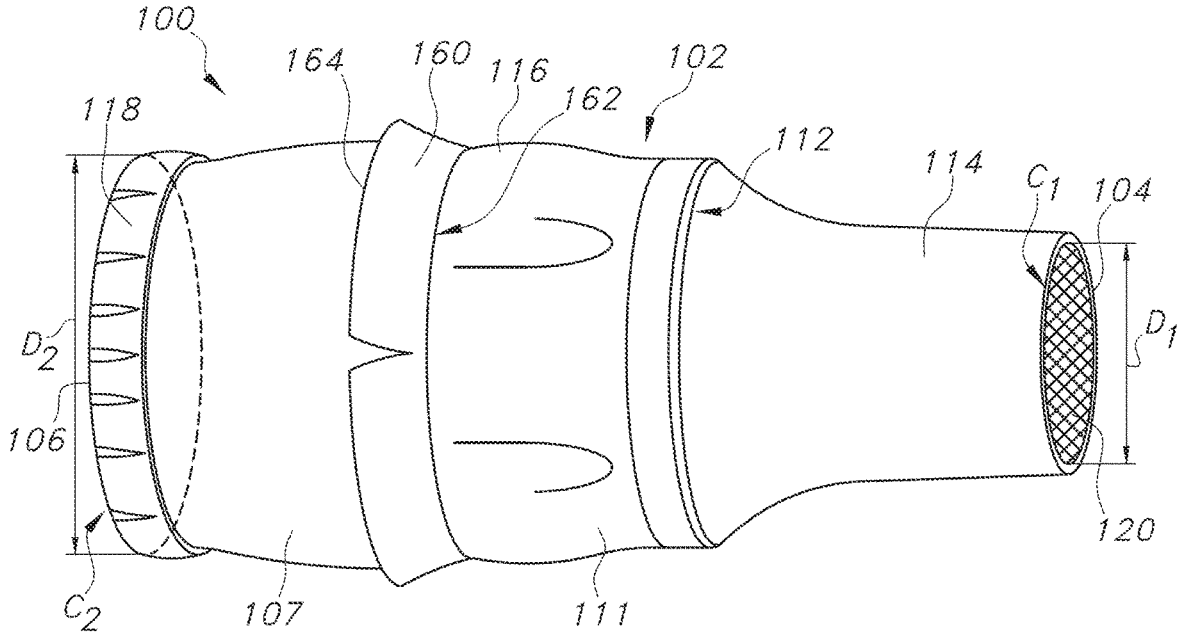
FIG. 2A illustrates a side perspective view of an accessory cuff of one particular embodiment of the present invention.
Figure 2B:
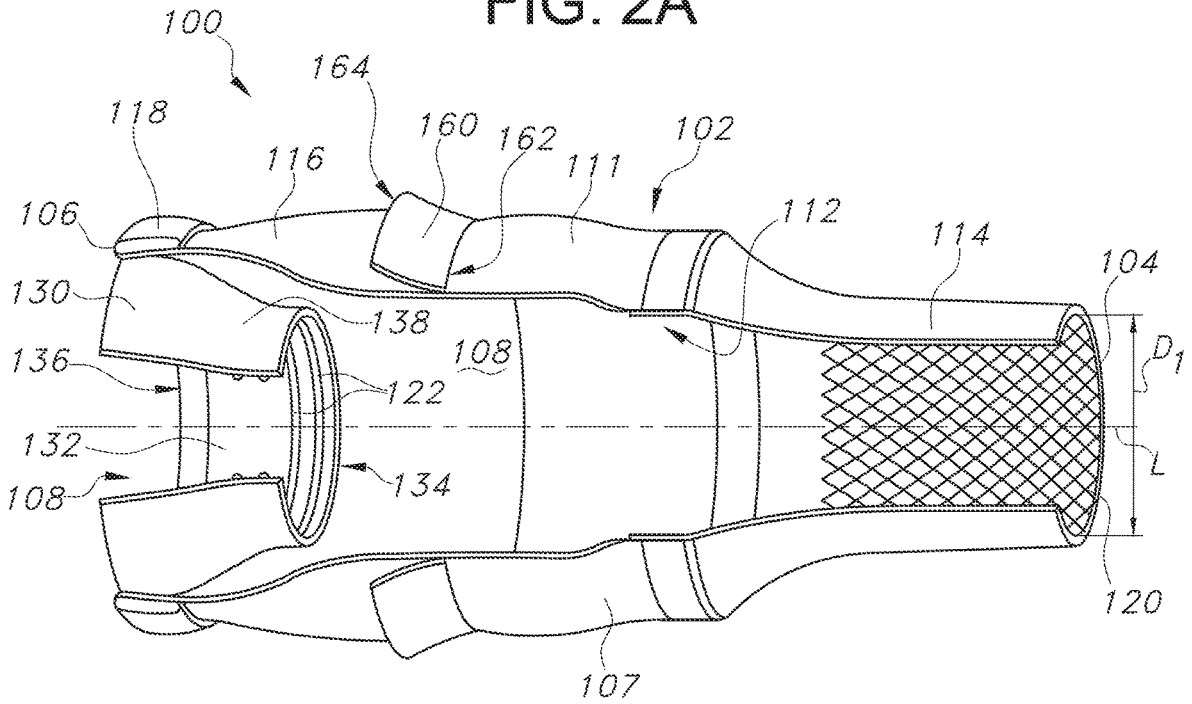
FIG. 2B illustrates a partial cutaway view of the accessory cuff of FIG. 2A.

Turning now to FIGS. 2A-2B, an accessory cuff 100 of one example of an embodiment of the present invention is shown. The accessory cuff 100 has a body 102 extending from a proximal end 104 to a distal end 106 along a longitudinal axis L (see FIG. 2B). The body includes a lumen 108 extending therethrough. The lumen 108 is defined by a wall 107. The wall 107 has an inner surface 110 facing the lumen 108 and an external facing surface 111. The wall 107 can be formed from a single layer or multiple layers. In use, a wearer may don the accessory cuff 100 with his or her arm through the lumen 108 such that the proximal end 104 is positioned near the thumb of the wearer's hand 30 and the distal end 106 is disposed over the wearer's forearm 34. The proximal end 104 is configured to form a seal around the wearer's hand 30, and the distal end 106 is configured to form a seal around the wearer's forearm 34 (see FIG. 1), such that the accessory cuff 100 can form a fluid impervious barrier that is configured to prevent fluid, such as liquids or bodily fluids, and other contaminants from entering the lumen 108. In some embodiments, the proximal end 104 and the distal end 106 may be reversible such that the distal end 106 can be positioned near the thumb of the wearer's hand 30 and the proximal end 104 can be disposed over the wearer's forearm 34.

The body 102 of the accessory cuff 100 can be formed from any suitable liquid impervious material, such as but not limited to polyurethane film; silicone, nitrile, latex, or other elastomeric materials; nonwoven barrier fabrics; or a combination thereof. The nonwoven barrier fabrics can include spunbond-meltblown-spunbond ("SMS") laminate fabrics, which may optionally be coupled with one or more elastic film layers in order to enhance the elasticity and flexibility of the nonwoven barrier fabric. Such nonwoven barrier fabrics may be moisture-vapor breathable while still maintaining a liquid-impervious barrier. For a general description of nonwoven barrier fabrics see U.S. Patent Application Publication 2019/0053551, which is herein incorporated by reference.

The accessory cuff 100 can be configured to extend from a wearer's hand 30 near the wearer's thumb, over the wearer's wrist 32 and extend over at least a portion of the wearer's forearm 34. The accessory cuff 100 can have a length L from the proximal end 104 to the distal end 106 in a range from about 3 inches (7.6 cm) to about 12 inches (31 cm), including any range or value therebetween, such as from about 4 inches (10 cm) to about 10 inches (25.5 cm), for example from about 5 inches (12 cm) to about 8 inches (20.5 cm). The proximal end 104 of the cuff 100 can have a diameter D1 and a circumference C1 of a suitable size to form a tight seal around the wearer's hand 30. For example, the diameter D1 of the proximal end 104 can be from about 2 inches (5 cm) to about 6 inches (15.5 cm), or any range or value therebetween, such as from about 2.5 inches (6.3 cm) to about 5 inches (12.7 cm), for example from about 3 inches (7.6 cm) to about 4 inches (10.2 cm). The circumference C1 of the proximal end 104 can be from about 5 inches (12.7 cm) to about 19 inches (48.5 cm), or any range or value therebetween, such as from about 6 inches (15.5 cm) to about 12 inches (31 cm), for example from about 7 inches (17.7 cm) to about 10 inches (25.5 cm). When the proximal end 104 of the body 102 is made from an elastomeric material, the diameter D1 and/or the circumference C1 can be configured to be smaller than the diameter and/or circumference of the wearer's hand 30 such that the elastomeric material can stretch to form a seal around the wearer's hand 30.

Similarly, the distal end 106 of the cuff 102 can have a diameter D2 and a circumference C2 of a suitable size to form a tight seal around the wearer's forearm 34. For example, the diameter D2 of the distal end 106 can be from about 2 inches (5 cm) to about 8 inches (20.5 cm), or any range or value therebetween, such as from about 3 inches (7.6 cm) to about 7 inches (17.7 cm), for example from about 4 inches (10.2 cm) to about 6 inches (15.5 cm). The circumference C2 of the distal end 106 can be from about 5 inches (12.7 cm) to about 24 inches (61 cm), or any range or value therebetween, such as from about 6 inches (15.5 cm) to about 15 inches (38 cm), for example from about 8 inches (20.5 cm) to about 12 inches (30.5 cm). When the distal end 106 of the body 102, such as the sealing band 118, is made from an elastomeric material, the diameter D2 and/or the circumference C2 can be configured to be smaller than the diameter and/or circumference of the wearer's forearm 34 such that the elastomeric material can stretch to form a seal around the wearer's forearm 34.

In some embodiments, the diameter D1 of the proximal end 104 and the diameter D2 of the distal end 106 can be approximately equal. In other embodiments, the diameter D2 of the distal end 106 can be different from the diameter D1 of the proximal end 104, e.g., the diameter D2 can be greater than the diameter D1. Similarly, the circumference C1 and the circumference C2 can be approximately equal in some embodiments. Alternatively, the circumference C1 and the circumference C2 can be different in some embodiments, such as the circumference C2 being larger than the circumference C1.

Figure 3A:
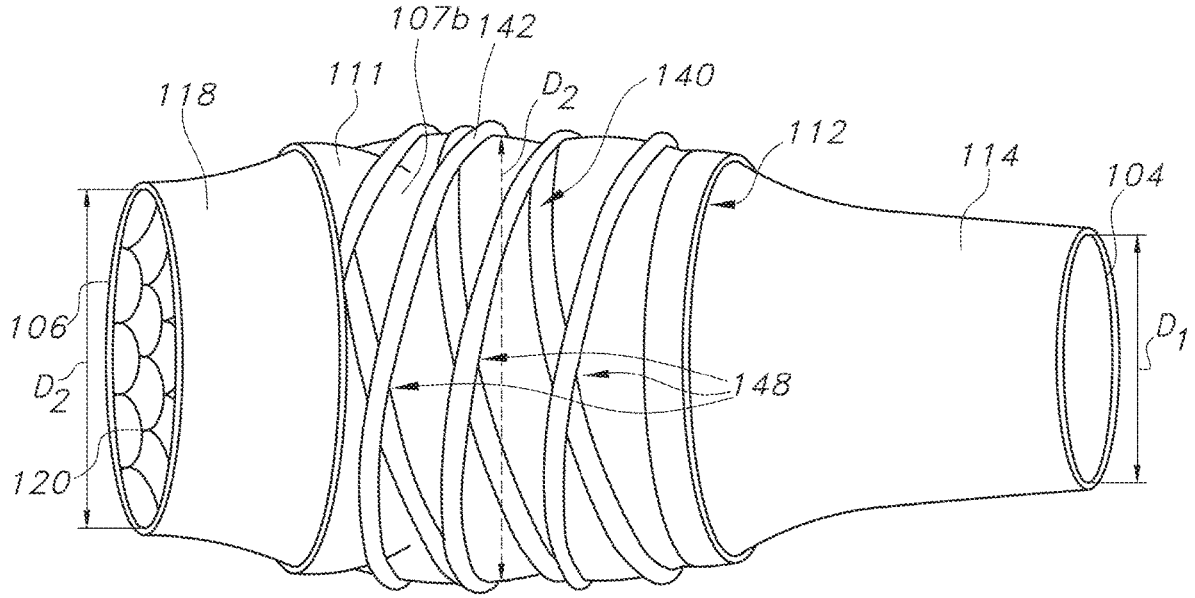
FIG. 3A illustrates a side perspective view of another embodiment of an accessory cuff according to the present invention.

Moreover, in some embodiments, the body 102 can have a portion between the proximal end 104 and the distal end 106 which can have different dimensions, i.e. a different diameter or circumference, than the respective diameters and/or circumferences of the proximal end 104 and/or the distal end 106. For example, as shown in FIG. 3A, a central portion of the body 102 can have a diameter D3 that is larger than the diameter D1 of the proximal end 104 and the diameter D2 of the distal end 106.

In some embodiments, the shape and size of the cuff body 102 can correlate with the material used to form the cuff 100. For example, non-elastomeric materials can have a larger diameter and/or circumference than elastomeric materials because the non-elastomeric materials do not stretch to conform to the anatomy of the wearer. For example, when a nonwoven barrier fabric is used to form a part of the cuff 100, the diameter and/or circumference can be larger than a corresponding section having elastomeric material.

As shown in FIGS. 2A-2B, the body 102 can include a proximal section 114 and a distal section 116. The proximal section 114 and the distal section 116 can be formed from two separate pieces of material attached together at a seam 112, as shown in FIGS. 2A-2B. In other embodiments, as described below and exemplarily shown in FIGS. 5A-B, the proximal section 114 and the distal section 114 of the body 102 can be integrally formed from a single piece of material. For example, in some embodiments, the proximal section 114 can be formed from an elastomeric material, e.g., as shown in FIGS. 2A-B, 3A-B and 5A-B. such as nitrile, natural rubber latex, silicone, or any other suitable elastomeric material. The distal section 116 can be formed from any suitable liquid impervious material, such as but not limited to polyurethane film; silicone, nitrile, latex, or other elastomeric materials; nonwoven barrier fabrics; or a combination thereof.

The inner surface 110 of the wall 107 of the cuff body 102 can include a textured portion 120, as exemplarily shown in FIGS. 2A-B, 3A-B and 5A-B. The textured portion 120 can be a raised or thickened pattern on the inner surface 110. The textured portion 120 can be formed from nitrile, latex, silicone, or any other elastomeric material and coupled to the inner surface 110. The elastomeric material can be integrally formed with the inner surface 110, such as by molding or extruding, or it can be formed and affixed to the inner surface, such as by printing, molding, extruding, or any other suitable process for forming an elastomeric material into a particular design or shape. The pattern can be formed from diamond grid lines, rectangular grid lines, honeycomb, scalloped, a raised tooth pattern, or any other geometric shape or design. The textured portion 120 can provide an increased frictional barrier between the inner surface 110 of the wall 107 of the accessory cuff 100 and the wearer. For example, when inner surface 110 of the wall 107 of the proximal portion 114 of the body 102 includes a textured portion 120, the textured portion 120 can extend over and frictionally engage the wearer's hand 30 and wrist 32, such as by frictionally engaging an elastomeric glove 20 worn by the wearer. In addition, the textured portion 120 can frictionally engage with the cuff of the gown sleeve 10 and/or the gown sleeve 10. The textured portion 120 can be on a portion of the inner surface 110, such as in the proximal section 114 or the distal section 116, or any portion therebetween. The textured portion 120 can extend around the circumference of the inner surface 110 or may only be on a portion of the radius of the inner surface 110. Alternatively, the textured portion 120 can extend around the entire circumference and length from the proximal end 104 to the distal end 106 of the inner surface 110 (not shown).

Additionally or alternatively, and as shown in FIG. 2B, the inner surface 110 can include at least one rib 122. The at least one rib 122 can be a ring positioned on the inner surface 110. The at least one rib 122 can be formed from an elastomeric material such as silicone in order to provide a frictional barrier against any object that interfaces with the at least one rib 122, such as the wearer's gown sleeve or glove. The at least one rib 122 can be placed anywhere on the inner surface 110 of the wall 107 surrounding the lumen 108 of the cuff body 102. For example, at least one rib 122 can be formed on the inner surface 110 adjacent to the proximal end 104 and/or the distal end 106 of the body 102 such that the frictional barrier formed by the at least one rib 122 can provide a seal at the proximal end 104 and/or distal end 106. In one embodiment, the at least one rib 122 can be at least two silicone ribs 122 positioned adjacent to each other, e.g., as shown in FIG. 2B, in order to form a ribbed interior frictional surface.

Figure 3B:
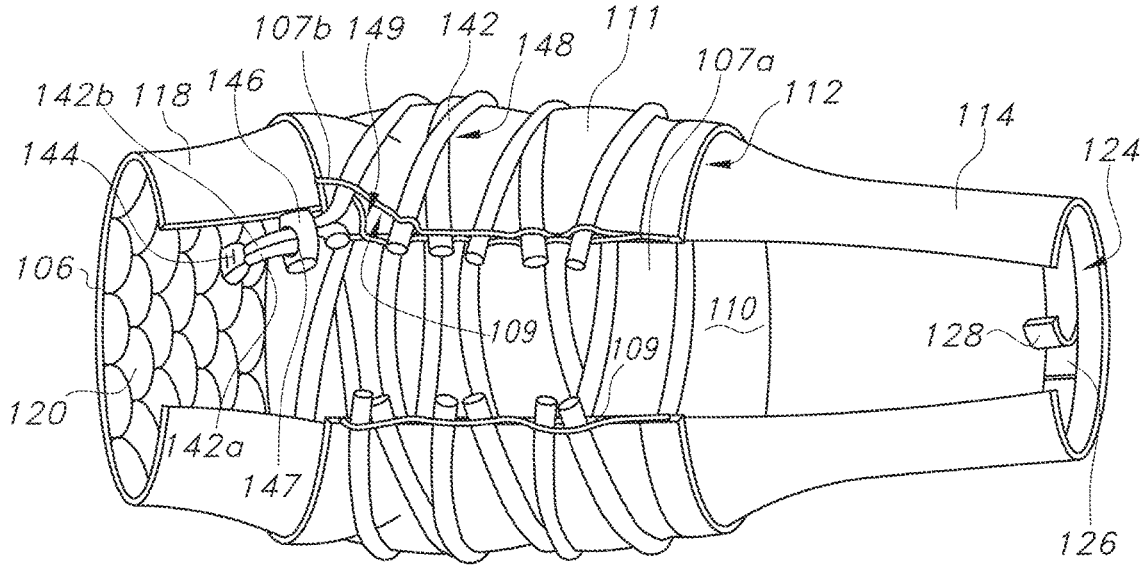
FIG. 3B illustrates a partial cutaway view of the accessory cuff of FIG. 3A.

Additionally or alternatively, as best shown in FIG. 3B, the inner surface 110 of the wall 107 can include at least one adhesive portion 124. The adhesive portion 124 can be a ring of adhesive material 126 on the inner surface 110. The adhesive portion 124 can further include a removable cover 128 configured to protect the adhesive material 126. For example, the removable cover 128 can have a size and shape generally equal to or slightly larger (e.g., longer in length and/or with a greater width) than the adhesive material 126 in order to fully protect the adhesive material 126. The removable cover 128 can be removed, e.g., peeled away, from the adhesive material 126 to expose the adhesive material 126 in order to be able to adhere the adhesive material 126 to a target surface. For example, as shown in FIG. 3B, the cuff 100 can have a ring of adhesive material 126 on the inner surface 110 near or at the proximal end 104 of the body 102. The adhesive material 126 can be in the form of a ring and protected by a removable cover 128 (e.g., a strip). When the removable cover 128 is removed, e.g., peeled away, from the ring of adhesive material 126, the adhesive material 126 can be exposed so that it can be adhered to a substrate, such as a surgical glove 20 of a wearer. In particular, it can be desirable to remove the removable cover strip 128 after a wearer has donned the cuff 100 over a gown-glove interface 50, then adhere the adhesive material to the glove 20.

Figure 5A:
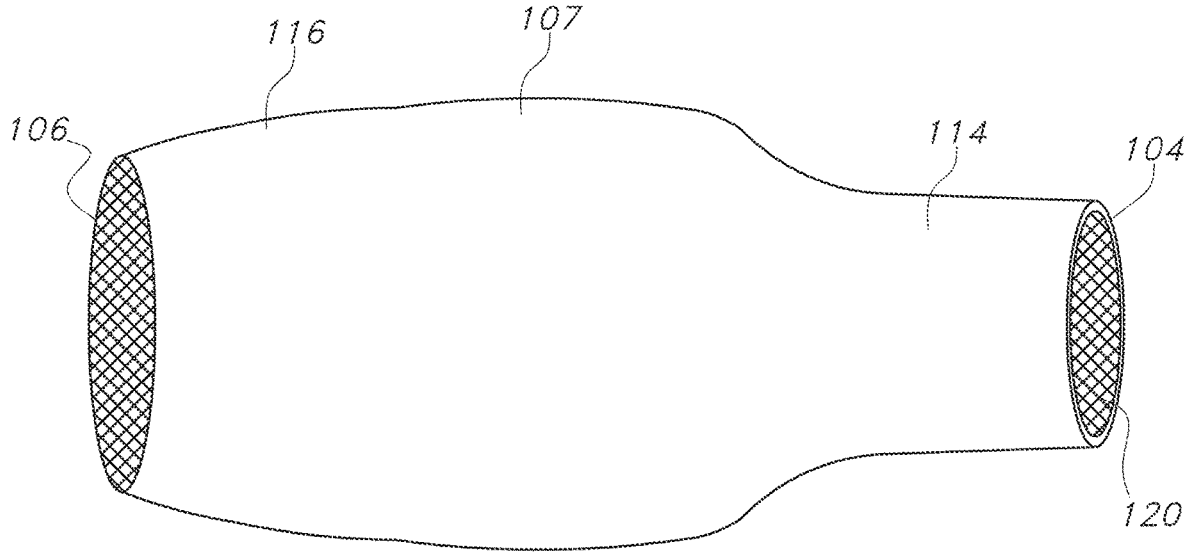
FIG. 5A illustrates a side perspective view of an accessory cuff of one particular embodiment of the present invention.
Figure 5B:
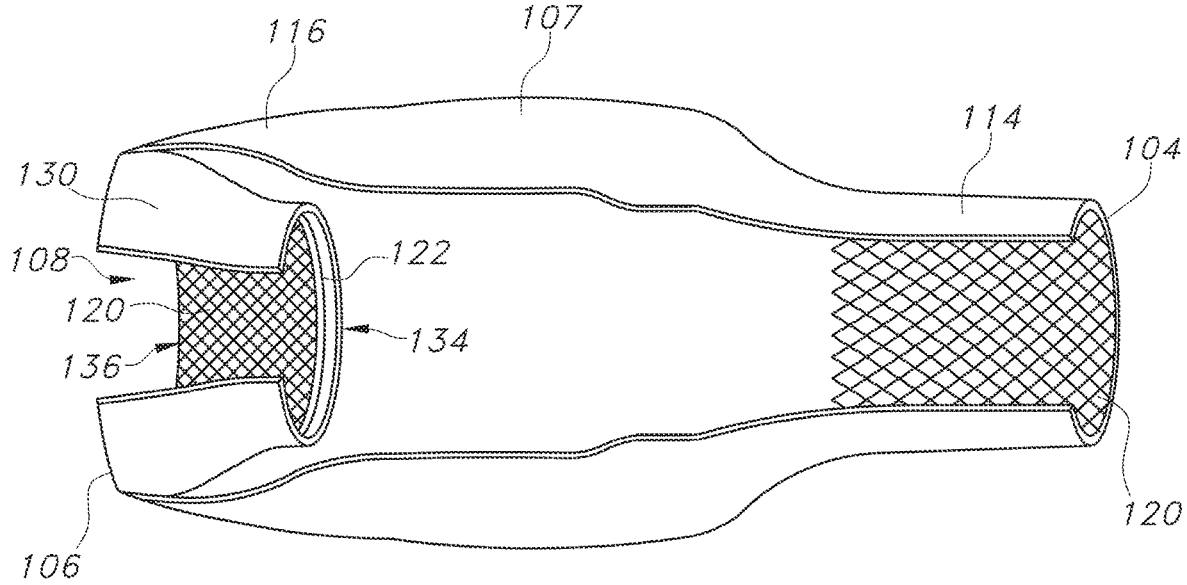
FIG. 5B illustrates a partial cutaway view of the accessory cuff of FIG. 5A.

As best illustrated in FIGS. 2B and 5B, the accessory cuff 100 can further include an inverted cuff 130 at the distal end 106. The inverted cuff 130 is configured to be disposed within the lumen 108 of the body 102 of the accessory cuff 100. The inverted cuff 130 can include an inner surface 132 and an outer surface 138 which both extend from a proximal end 134 to a distal end 136. The distal end 136 of the inverse cuff 130 is configured to align with the distal end 106 of the body 102 and can be coupled to the distal end 106 of the body 102 by any suitable means. For example, the inverted cuff 130 can be coupled to the distal end 106 of the body 102 via adhesive, ultrasonic bonding, thermal bonding, or other suitable attachment. In one embodiment, as shown in FIG. 2B, the inverted cuff 130 can be coupled to the distal end 106 of the body 102 at a sealing ring 118 of the distal end 106. Alternatively, as illustrated in FIG. 5B, the inverted cuff 130 can be integrally formed with the body 102, such as by molding.

The accessory cuff 100 can have a flexible or adjustable fit in order to be able to provide a custom fit to a wearer's anatomical size and shape. For example, as shown in FIGS. 2A-B and 4A-B, when an elastomeric material is used to form at least a portion of the cuff 100, such as the proximal section 114 in FIGS. 2A-B and 4A-B, the elastomeric material can stretch to provide a custom fit around the wearer's hand 30 or forearm 34. In some embodiments, the elastomeric material used to form at least a portion of the cuff 100 can be formed to include a thickened elastomer band 115. In the example embodiment shown in FIGS. 4A-B, the cuff body 102 includes a thickened elastomeric band 115 integrally formed with an elastomeric proximal section 114 of the cuff body 102. The thickened elastomeric band 115 can provide a frictional barrier to resist movement of the proximal section 114 of the cuff body 102 relative to the wearer or the gown-glove interface 50. The thickened elastomeric band 115 can be molded, extruded, or otherwise integrally formed with the elastomeric proximal section 114. The thickened elastomeric band 115 can protrude from the proximal section 114 into the lumen 108 and/or in a direction distal to the wearer.

Figure 4A:
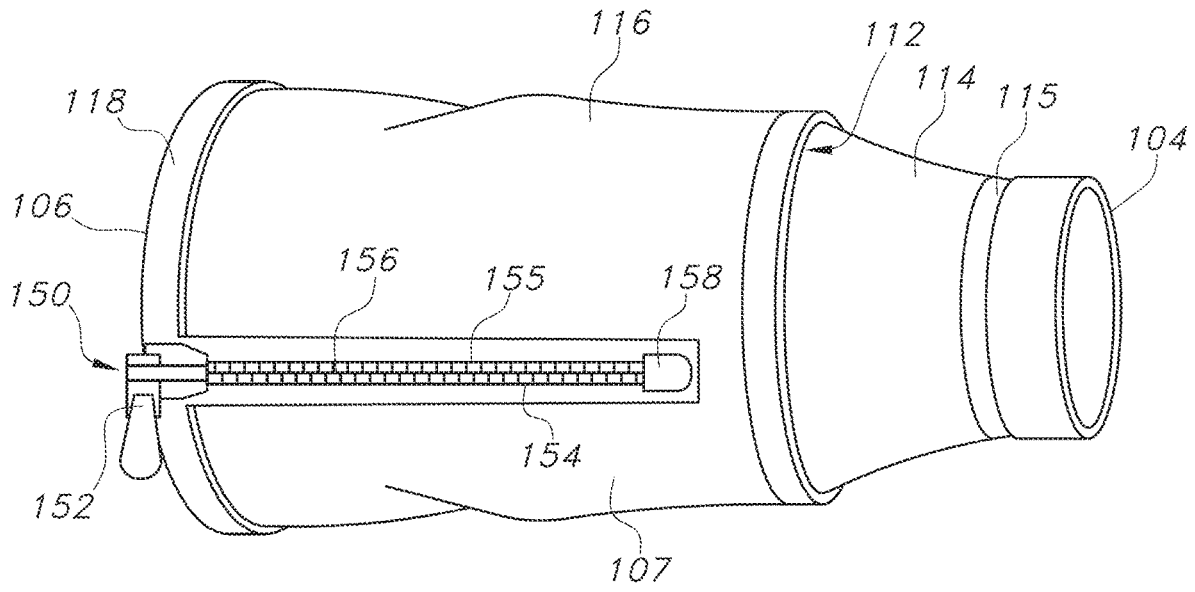
FIG. 4A illustrates a side perspective view of an accessory cuff of one particular embodiment of the present invention.
Figure 4B:
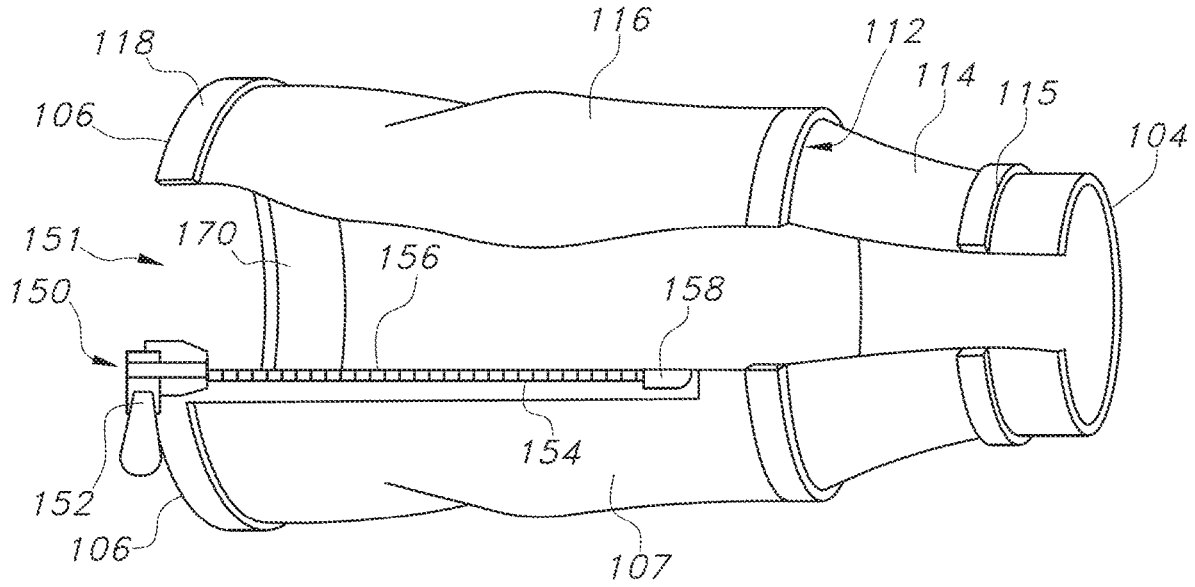
FIG. 4B illustrates a partial cutaway view of the accessory cuff of FIG. 4A.

In some embodiments, for example as shown in FIG. 4B, the accessory cuff 100 can include an absorptive polymer that expands upon the absorption of fluid. For example, the absorptive polymer can be in the form of an absorptive polymer strip 170 as shown in FIG. 4B. The absorptive polymer strip 170 can be placed near the distal end 106, as shown in FIG. 4B, or near the proximal end 104. The absorptive polymer strip 170 can be located on the inner surface 110 of the cuff body 102. In some embodiments, e.g., as shown in FIG. 4B, the absorptive polymer strip 170 can be in the form of a ring around the circumference of the inner surface 110 surrounding the lumen 108. In other embodiments (not shown), the cuff body 102 can include one or more absorptive polymer sections, e.g., strips or rings, on or around the inner surface 110 and/or outer surface 111 of the cuff body 102. When the absorptive polymer, e.g., absorptive polymer strip 170 of FIG. 4B, expands upon the absorption of fluid, e.g., bodily fluids when the cuff 100 is worn during a surgical procedure, the absorptive polymer swells and increases in volume. Thus, the expanded absorptive polymer can enhance the seal between the cuff 100 and the wearer's hand 30 or forearm 34 by increasing the pressure and tightening the fit between the cuff 100 and the wearer's hand 30 or forearm 34. The absorptive polymer can be, for instance, a superabsorbent powder incorporated into a binder to form the absorbent polymer strip 170. The superabsorbent polymer can absorb and retain extremely large amounts of liquid relative to its own mass, and thus swells to retain fluids that it comes into contact with. For instance, the superabsorbent material can include poly (acrylic acid), poly(methacrylic acid), poly(acrylamides), poly(vinyl ethers), a maleic anhydride copolymer with a vinyl ether and an α-olefin, poly(vinyl pyrrolidone), poly (vinylmorpholinone), poly(vinyl alcohol), hydrolyzed acrylonitrile-grafted starch, acrylic acid-grafted starch, methyl cellulose, chitosan, carboxymethyl cellulose, hydroxypropyl cellulose, alginate, xanthan gum, locust bean gum, or a combination thereof. Additionally, the accessory cuff can be an expandable material such as a cotton, non-woven, or type of fabric other than a superabsorbent that absorbs fluid and increases in volume.

The body 102 of the accessory cuff 100 can also include a waterproof zipper closure 150, as shown in FIGS. 4A-B. For example, the waterproof zipper closure 150 can provide an opening to expand the distal end 106 of the cuff body 102. The opening 151 can include a first side 154 and a second side 155 each having a plurality of cooperating zipper teeth 156. The zipper teeth 156 can extend from the distal end 106 to a zipper terminal end 158. A zipper pull 152 can zip the zipper teeth 156 together from the zipper terminal end 158 to the distal end 106. The waterproof zipper closure 150 can be a one-way zipper, as shown in FIGS. 4A-B, or a two-way zipper (not shown). The waterproof zipper closure 150 can be integrated into a fabric material, e.g., a nonwoven barrier material as described above, as a tightening mechanism to provide a snug or tight fit to the wearer's forearm 34 when zipped (as shown in FIG. 4A), while expanding the opening size of the distal end 106 for easy donning of the cuff 100 (as shown in FIG. 4B). Additionally, the waterproof zipper closure 150 can provide a fluid impervious seal to prevent fluid or other material from entering the lumen 108 of the cuff 100.

As illustrated in FIGS. 3A-B, the cuff 100 can additionally include an elastic scaffold 140 to further provide an adjustable fit for the cuff body 102. The elastic scaffold 140 can be formed from at least one piece of elastic material 142 disposed between an inner layer 107*a* and an outer layer 107*b* of the wall 107 of the body 102. A pocket 109 may be formed between the inner layer 107*a* and outer layer 107*b* of the wall 107, and the elastic scaffold 140 can be disposed within the pocket 109, as shown in FIG. 3B. The elastic scaffold 140 can further include an adjustable fastener 146 in operative communication with the at least one piece of elastic material 142. For example, the elastic scaffold 140 can be formed from a cord or strip of elastic material 142 wrapped around the inner surface 110 of the body 102, and the cord or strip of elastic material 142 can be coupled with the adjustable fastener 146 at each end, e.g., ends 142*a* and 142*b* illustrated in FIG. 3B, of the cord or strip 142. As shown in FIG. 3B, the elastic cord or strip 142 can be wrapped around the inner layer 107*a* of the wall 107. For example, the elastic cord or strip 142 can be wrapped multiple times circumferentially around the inner layer 107*a* of the wall 107. In one embodiment, as shown in FIGS. 3A-B, the wrapped elastic cord or strip 142 can form intersecting points 148 where one portion of the elastic cord or strip 142 wraps over or under another portion of the elastic cord or strip 142. The ends 142*a* and 142*b* of the elastic cord or strip 142 can be attached together, such as at a connector 144 as shown in FIG. 3B. In other embodiments (not shown), a connector 144 can be coupled to a single end of a piece of elastic material 142 in order to form a stopper at the end of the elastic material 142.

As shown in FIG. 3B, the adjustable fastener 146 can be an adjustable toggle configured to hold the elastic material 142 in place. For example, the ends 142*a* and 142*b* of the elastic material 142 can pass through an aperture 147 in the adjustable toggle 146. The connector 144 can hold the ends 142*a* and 142*b* together after passing the ends 142*a* and 142*b* through the aperture 147. In some embodiments, the connector 144 can have dimensions in the length and/or width direction that are larger than the dimensions of the aperture 147 such that the connector 144 cannot pass though the aperture 147, thus preventing removal of the adjustable fastener 146 from the elastic material 142 when the connector 144 is present. The position of the adjustable fastener 146 along the elastic material 142 can be adjusted by changing the amount of elastic material 142 pulled through the aperture 147 in order to tighten or loosen the elastic scaffold 140.

As shown in FIG. 3B, for example, the inner layer 107*a* of the wall 107 can have an opening 149 through which the elastic material 142 may extend. Thus, the adjustable fastener 146 can be disposed within the lumen 108 of the cuff body 102 while the elastic material 142 wraps around the inner layer 107*a* of the wall 107 within the pocket 109 of the cuff body 102. In some embodiments, the opening 149 can have a diameter smaller than the length and/or width of the adjustable fastener 146 such that the adjustable fastener 146 cannot pass through the opening 149 to the other side of the inner layer 107*a* of the wall 107. Such a configuration can prevent the adjustable fastener 146 from hanging outside the cuff body 102 and from being exposed to bodily fluids and/or other contaminants. In use, a wearer can loosen the adjustable fastener 146 prior to donning the cuff 100, then tighten the elastic material 142 using the adjustable fastener 146 within the lumen 108 of the cuff body 102 to form a comfortable yet snug fit.

Additionally, as shown in FIGS. 2A-B, the cuff body 102 can include a raised seam lip 160 coupled to the outer surface 111 of the cuff body 102. The raised seam lip 160 can form a skirt around the body 102 of the cuff 100 that is coupled to the cuff body 102 at a coupling end 162 and is not coupled to the cuff body 102 on a free end 164, as shown in FIGS. 2A-B. The raised seam lip 160 can be integrally formed, e.g., molded or extruded, with the cuff body 102 or it can be attached by a suitable attachment means, e.g., adhesive or ultrasonic bonding. The raised seam lip 160 can form a dam configured to move fluid away from the wearer's hand 30 and wrist 32 by directing the fluid away or off from the cuff body 102.

The present invention is further directed to methods of donning the cuff 100 of the present invention over a gown-glove interface 50. Prior to donning the cuff 100, a wearer may don a surgical gown such that a sleeve 10 of the gown extends to the wearer's wrist 32, then don a glove 20 over his or her hand such that a cuff of the glove 20 extends over the sleeve 10 of the gown at the wearer's wrist, forming a gown-glove interface 50. The accessory cuff body 102 may be disposed in a donning configuration. In the donning configuration, either the proximal section 114 or the distal section 116 may be folded inside out such that the outer surface 111 of the proximal section 114 overlaps the outer surface 111 of the distal section 116. For example, the proximal section 114 may be folded back toward the distal section 116 such that the proximal section 114 is inside-out with the inner surface 110 of the proximal section 114 exposed. The wearer may then insert his or her hand 30 and forearm 34 through the lumen 108 of the cuff body 102 at the distal end 16 of the cuff body 102. The cuff body 102 is then positioned, e.g., by sliding, on the wearer's forearm 34 over the sleeve 10 of the gown. When the distal end 106 of the cuff body 102 is positioned at a desired location, the proximal section 114 can be folded toward the wearer's wrist 32 and hand 30 such that the inner surface 110 of the proximal section 114 contacts and/or covers the gown-glove interface 50 and the proximal end 104 of the cuff body 102 extends beyond the wearer's wrist 32 and onto the glove 20 on the wearer's hand 30. Finally, if present, the elastic material 142 of an elastic scaffold 140 can be tightened using an adjustable fastener 146, and/or an adhesive material 126 can be exposed to adhere to the gown sleeve 10 and/or the glove 20 to secure the cuff body 102 over the gown/glove interface 50.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. An accessory cuff for reinforcement of a gown-glove interface, the accessory cuff comprising:

a body extending from a proximal end to a distal end along a longitudinal axis, the body having a lumen extending therethrough from the proximal end to the distal end, and a wall surrounding the lumen;

wherein the body comprises a proximal section including a first piece of material at the proximal end, and a distal section including a second piece of material and including the distal end, and a seam formed between the proximal section and the distal section about a circumference of the lumen at which the first piece of material and second piece of material are attached;

wherein the first piece of material includes a textured portion, wherein the textured portion comprises a raised or thickened pattern formed from an elastomeric material present on an inner surface of the proximal section;

wherein the accessory cuff is configured to create a fluid impervious barrier to prevent fluid from entering the lumen when the accessory cuff is sealed at the proximal end and the distal end.

2. The accessory cuff of claim 1, wherein at least one of the proximal end and the distal end comprises a seal.

3. The accessory cuff of claim 2, wherein the seal is formed by a friction fit.

4. The accessory cuff of claim 2, wherein the seal is formed by adhesive.

5. The accessory cuff of claim 2, wherein the seal is formed by an elastomeric material.

6. The accessory cuff of claim 2, wherein the seal is formed by an absorptive polymer.

7. The accessory cuff of claim 1, wherein the body further comprises at least one elastomeric ring surrounding the lumen.

8. The accessory cuff of claim 1, wherein the proximal section comprises a first material and the distal section comprises a second material.

9. The accessory cuff of claim 8, wherein the first material is elastomeric.

10. The accessory cuff of claim 1, wherein the proximal section and the distal section comprise the same material.

11. The accessory cuff of claim 1, wherein the body further comprises an inverse cuff, wherein the inverse cuff is configured to be disposed within the lumen.

12. The accessory cuff of claim 1, wherein the body further comprises an outer wall having a lip disposed between the proximal end and the distal end.

13. The accessory cuff of claim 1, wherein the body has an adjustable fit.

14. The accessory cuff of claim 1, wherein the body further comprises an elastic scaffold, the elastic scaffold comprising at least one piece of elastic material surrounding an inner layer of the wall and an adjustable fastener in operative communication with the at least one piece of elastic material.

15. The accessory cuff of claim 14, wherein the adjustable fastener is configured to be disposed in the lumen of the body.

16. The accessory cuff of claim 14, wherein the elastic scaffold is disposed between the inner layer and an outer layer of the wall.

17. The accessory cuff of claim 1, wherein the body comprises a nonwoven barrier sheet material.

18. The accessory cuff of claim 1, further comprising a waterproof zipper.

19. The accessory cuff of claim 1, wherein the lumen has a first diameter at the proximal end and a second diameter at the distal end.

20. The accessory cuff of claim 19, wherein the first diameter and the second diameter are not equal.

* * * * *